US006471208B2

(12) United States Patent
Yoseloff et al.

(10) Patent No.: US 6,471,208 B2
(45) Date of Patent: Oct. 29, 2002

(54) METHOD OF PLAYING A GAME, APPARATUS FOR PLAYING A GAME AND GAME WITH MULTIPLIER BONUS FEATURE

(75) Inventors: Mark L. Yoseloff; Russell B. Dunn, both of Henderson, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 09/394,748

(22) Filed: Sep. 13, 1999

(65) Prior Publication Data

US 2001/0048193 A1 Dec. 6, 2001

Related U.S. Application Data

(63) Continuation-in-part of application No. 08/820,438, filed on Mar. 12, 1997.

(51) Int. Cl.[7] ..... A63B 71/00

(52) U.S. Cl. ..... 273/143 R; 273/138 A; 463/16; 463/20; 463/9

(58) Field of Search ..... 273/143 R, 138 A, 273/138 R, 138; 463/20, 16, 46, 21, 9

(56) References Cited

U.S. PATENT DOCUMENTS

| | | | | |
|---|---|---|---|---|
| 4,861,041 A | | 8/1989 | Jones et al. | |
| 5,019,973 A | | 5/1991 | Wilcox et al. | |
| 5,033,744 A | | 7/1991 | Bridgeman et al. | |
| 5,098,107 A | | 3/1992 | Boylan et al. | |
| 5,259,616 A | * | 11/1993 | Bergmann | 273/138 |
| 5,288,077 A | | 2/1994 | Jones | |
| 5,288,081 A | | 2/1994 | Breeding | |
| 5,332,219 A | | 7/1994 | Marnell, II et al. | |
| 5,364,105 A | | 11/1994 | Jones | |
| 5,377,973 A | | 1/1995 | Jones et al. | |

FOREIGN PATENT DOCUMENTS

| | | | | |
|---|---|---|---|---|
| DE | 3700861 A1 | | 7/1988 | G07F/17/32 |
| DE | 4014477 A1 | | 7/1991 | G07C/15/00 |
| GB | 2072395 A | | 9/1981 | G07F/17/34 |
| GB | 2072395 | * | 9/1981 | |
| GB | 2322217 | * | 9/1981 | |
| GB | 2201821 A | | 9/1988 | G07F/17/34 |
| GB | 2202984 A | | 10/1988 | G07F/17/34 |

(List continued on next page.)

*Primary Examiner*—Benjamin H. Layno
*Assistant Examiner*—Dolores R Collins
(74) *Attorney, Agent, or Firm*—Mark A. Litman & Assoc. P.A.

(57) ABSTRACT

A method of playing a wagering game comprises:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment if the player obtains a predetermined qualifying outcome in the first game segment;

the second segment randomly determines a factor as a determined factor; and awarding the player a second payout that is equal to the determined factor multiplying at least one of:

a) the wager placed to participate in said game;

b) the first payout amount; and d) the wager placed to participate in said game and the first payout amount.

Apparatus used for playing the wagering game may include a panel display with randomly displayed factors for use in the second gaming segment.

28 Claims, 3 Drawing Sheets

U.S. PATENT DOCUMENTS 5,393,057 A 2/1995 Marnell, II
5,393,061 A 2/1995 Manship et al.
5,409,225 A * 4/1995 Kelly et al. ..... 273/138 R
5,494,287 A 2/1996 Manz
5,511,781 A 4/1996 Wood et al.
5,529,309 A 6/1996 Bartlett
5,531,440 A 7/1996 Dabrowski et al.
5,531,441 A 7/1996 Dabrowski et al.
5,542,669 A 8/1996 Charron et al.
5,577,731 A 11/1996 Jones
5,584,485 A 12/1996 Jones et al.
5,607,162 A 3/1997 Boylan et al.
5,626,341 A 5/1997 Jones et al.
5,660,391 A 8/1997 Klasee
5,660,393 A 8/1997 Dreger
5,664,781 A 9/1997 Feola
5,775,692 A * 7/1998 Watts et al. ..... 273/143 R
5,794,964 A 8/1998 Jones et al.
5,795,225 A 8/1998 Jones et al.
5,823,874 A * 10/1998 Adams ..... 463/17
5,848,932 A * 12/1998 Adams ..... 463/20
5,863,041 A 1/1999 Boylan et al.
5,882,261 A * 3/1999 Adams ..... 463/20
5,890,962 A * 4/1999 Takemoto ..... 463/20
5,919,088 A * 7/1999 Weiss ..... 463/9
6,004,207 A * 12/1999 Wilson, Jr. et al. ..... 463/20
6,012,982 A * 1/2000 Piechowiak et al. ..... 463/16

* cited by examiner

METHOD OF PLAYING A GAME, APPARATUS FOR PLAYING A GAME AND GAME WITH MULTIPLIER BONUS FEATURE

RELATED APPLICATIONS

This application is a continuation-in-part application claiming priority from U.S. patent application Ser. No. 08/820,438, filed Mar. 12, 1997, entitled "METHOD OF SCORING A VIDEO WAGERING GAME."

BACKGROUND OF THE INVENTION

1. Field of the Invention

The present invention is directed to novel gaming devices, novel gaming processes and novel games wherein an event after the play of a first gaming segment, a bonus segment is entered where multiplying factors may be encountered.

2. Background of the Art

Games of chance have been enjoyed by people for thousands of years and have enjoyed increased and widespread popularity in recent times. As with most forms of entertainment, players enjoy playing a wide variety of games and new games. Playing new games adds to the excitement of "gaming." As is well known in the art and as used herein, the term "gaming" and "gaming devices" are used to indicate that some form of wagering is involved, and that players must make wagers of value, whether actual currency or some equivalent of value, e.g., token or credit.

One popular game of chance is the slot machine. Conventionally, a slot machine is configured for a player to wager something of value, e.g., currency, house token, established credit or other representation of currency or credit. After the wager has been made, the player activates the slot machine to cause a random event to occur. The player wagers that particular random events will occur that will return value to the player. A standard device causes a plurality of reels to spin and ultimately stop, displaying a random combination of some form of indicia, for example, numbers or symbols. If this display contains one of a preselected plurality of winning combinations, the machine releases money into a payout chute or increments a credit meter by the amount won by the player. For example, if a player initially wagered two coins of a specific denomination and that player achieved a payout, that player may receive the same number or multiples of the wager amount in coins of the same denomination as wagered.

There are many different formats for generating the random display of events that can occur to determine payouts in wagering devices. The standard or original format was the use of three reels with symbols distributed over the face of the wheel. When the three reels were spun, they would eventually each stop in turn, displaying a combination of three three symbols (e.g., with three wheels and the use of a single payout line as a row in the middle of the area where the symbols are displayed. By appropriately distributing and varying the symbols on each of the reels, the random occurrence of predetermined winning combinations can be provided in mathematically predetermined probabilities. By clearly providing for specific probabilities for each of the preselected winning outcomes, precise odds that would control the amount of the payout for any particular combination and the percentage return on wagers for the house could be readily controlled.

Other formats of gaming apparatus that have developed in a progression from the pure slot machine with three reels have dramatically increased with the development of video gaming apparatus. Rather than have only mechanical elements such as wheels or reels that turn and stop to randomly display symbols, video gaming apparatus and the rapidly increasing sophistication in hardware and software have enabled an explosion of new and exciting gaming apparatus. The earlier video apparatus merely imitated or simulated the mechanical slot games in the belief that players would want to play only the same games. Early video games therefore were simulated slot machines. The use of video gaming apparatus to play new games such as draw poker and Keno broke the ground for the realization that there were many untapped formats for gaming apparatus. Now casinos may have hundreds of different types of gaming apparatus with an equal number of significant differences in play. The apparatus may vary from traditional three reel slot machines with a single payout line, video simulations of three reel video slot machines, to five reel, five column simulated slot machines with a choice of twenty or more distinct paylines, including randomly placed lines, scatter pays, or single image payouts. In addition to the variation in formats for the play of games, bonus plays, bonus awards, and progressive jackpots have been introduced with great success. The bonuses may be associated with the play of games that are quite distinct from the play of the original game, such as the video display of a horse race with 'bets' on the individual horses randomly assigned to players that qualify for a bonus, the spinning of a random wheel with fixed amounts of a bonus payout on the wheel (or simulation thereof), or attempting to select a random card that is of higher value than a card exposed on behalf of a virtual "dealer."

Examples of such gaming apparatus with a distinct bonus feature includes U.S. Pat. Nos. 5,823,874; 5,848,932; 5,836,041; U.K. Patent Nos. 2 201 821 A; 2 202 984 A; and 2 072 395A; and German Patent DE 40 14 477 A1. Each of these patents differ in fairly subtle ways as to the manner in which the bonus round is played. British patent 2 201 821 A and DE 37 00 861 A1 describe a gaming apparatus in which after a winning outcome is first achieved in a reel-type gaming segment, a second segment is engaged to determine the amount of money or extra games awarded. The second segment gaming play involves a spinning wheel with awards listed thereon (e.g., the number of coins or number of extra plays) and a spinning arrow that will point to segments of the wheel with the values of the awards thereon. A player will press a stop button and the arrow will point to one of the values. The specification indicates both that there is a level of skill possibly involved in the stopping of the wheel and the arrow(s), and also that an associated computer operates the random selection of the rotatable numbers and determines the results in the additional winning game, which indicates some level of random selection in the second gaming segment.

U.K. Patent No. 2 202 984 A describes a slot machine in which when a player has not won a prize in the basic game (that in itself is a randomly determined event), there is the possibility of winning a prize in a complementary game of chance, such as a lottery where numbered balls are removed from a rotating drum device.

U.K. Patent No. 2 072 395 A describes a gaming or amusement machine having a spinning reel device and a video screen on which a video game may be displayed. A play on the video game may be an award for winning events on the reels.

U.S. Pat. Nos. 5,823,874 and 5,848,932 describe a gaming device comprising: a first, standard gaming unit for displaying a randomly selected combination of indicia, said displayed indicia selected from the group consisting of reels, indicia of reels, indicia of playing cards, and combinations thereof; means for generating at least one signal corresponding to at least one select display of indicia by said first, standard gaming unit; means for providing at least one discernible indicia of a mechanical bonus indicator, said discernible indicia indicating at least one of a plurality of possible bonuses, wherein said providing means is operatively connected to said first, standard gaming unit and becomes actuatable in response to said signal. In effect, the second gaming event simulates a mechanical bonus indicator such as a roulette wheel or wheel with a pointing element.

Since it is desirable to offer players games which they have not played before, it would be desirable to provide new games with new additional opportunities to receive winning payouts.

SUMMARY OF THE INVENTION

A game, gaming process and gaming apparatus of the invention provides a first gaming segment in which after a player provides an initial wager, randomly selected events provide a first distribution of symbols that are considered to determine if a defining event occurs, such as a predetermined arrangement, predetermined order, predetermined number of preselected symbols located anywhere on the display, or predetermined combination of symbols on a pay line, for example, occurs. Upon the occurrence of a defining event, a player wins a predetermined amount for the event that he can carry into a bonus event or so that the player can carry the initial wager into a bonus event. The bonus event comprises at least one gaming segment, at least two gaming segments, or a series of at least two related gaming play segments that are substantively different from the first gaming segment. At least one of the second gaming segments comprises a display of multiple panels, such as frames within one or more video monitors, that display symbols, such as multiplication factors. The symbols or factors within each frame change over time, either randomly or in sequence. If the game is a multiple bonus segment game, different symbols or factors appear within at least some of the frames or certain symbols appear at a different frequency during subsequent bonus segments. At least one highlighting feature, such as increased or decreased light intensity of the frames optionally occurs during the time when the symbols or factors are changing. The random selection may also occur without any highlighting so that their selection has no visual imagery except for the conclusion. A player may activate a stop button to halt both the changing of symbols or factors within a frame and stop the highlighting feature so that at least one frame is highlighted. The highlighted frame presents a multiplication factor that is applied to the wager or the amount awarded from the occurrence of the predetermined event in the first play segment. The result of the multiplication of the initial wager or the amount awarded is then preferably carried forward into at least one more (and preferably two more) second gaming segments that include a multiplier.

The first segment of the gaming device of the present invention is preferably a video simulation of a five reel slot game. The game display is five reels wide, and three symbols high, displaying a total of fifteen symbols per round of play. The first segment preferably pays for combinations of symbols occurring on one or more pay lines that can be horizontal, vertical, diagonal or irregularly shaped. Preferably, the occurrence of a minimum number of a single predefined "trigger" symbol(s) appearing anywhere on the screen display pays a payout as a scatter pay and also triggers the bonus event.

DETAILED DESCRIPTION OF THE INVENTION

The various embodiments of the present invention are designed to provide added excitement to a gaming device and to increase the enjoyment to players. The underlying concept in the practice of the invention comprises a game, gaming process and gaming apparatus to implement the game. The game comprises a player entering a first gaming segment. Players usually enter first gaming segments by placing a wager on a randomly occurring event, such as the play of a reel slot apparatus (either mechanical or virtual), a video poker apparatus (e.g., either 3, 4, 5, 6, or 7 card stud, draw poker, wild card poker, or pai gow poker or variants thereon), a roulette apparatus, Twenty-One apparatus, Keno apparatus, or any other random event gaming device. The wager may be placed by insertion of coins or tokens, accessing credit directly, inserting currency or credit cards to establish a line of credit, or diminishing existing credit evidenced in the apparatus (as on a credit display).

The first segment game is preferably a five reel video slot simulation game. Each "virtual" reel contains a predetermined symbol set, and appearing according to a predetermined frequency of occurrence. Examples of symbols that can be used are cherries, plums, watermelon, other fruit and specialty symbols.

The preferred specialty symbols include a "whammy", in the form of an animated devil that serves as the trigger symbol for the bonus feature. Preferably, the whammy symbol must appear in three locations on the screen display to trigger the second or bonus segment. The screen display displays five symbols across and three symbols high, for a total of fifteen symbols. Preferably, the number of trigger symbols appearing on the screen display in the first segment determines the number of rounds of bonus play in the bonus segment of the game. Assignee's copending application describes a method of providing second screen multiplier features in a video wagering game. The subject matter of that copending application, "Method of Scoring a Video Wagerin Game", Ser. No. 08/820,438, filed Mar. 12, 1997 is herein incorporated by reference.

Preferably, the presence of three "whammy's" anywhere on the 5×3 display define a winning combination and pay a scatter pay. This same event triggers the bonus round of play, then the player is awarded three opportunities to participate in the bonus segment. Although in the example provided above the triggering event is a winning event, it is not necessary to award the player a payout in the first segment to qualify the player to participate in the second segment of the game.

Figure 1A:
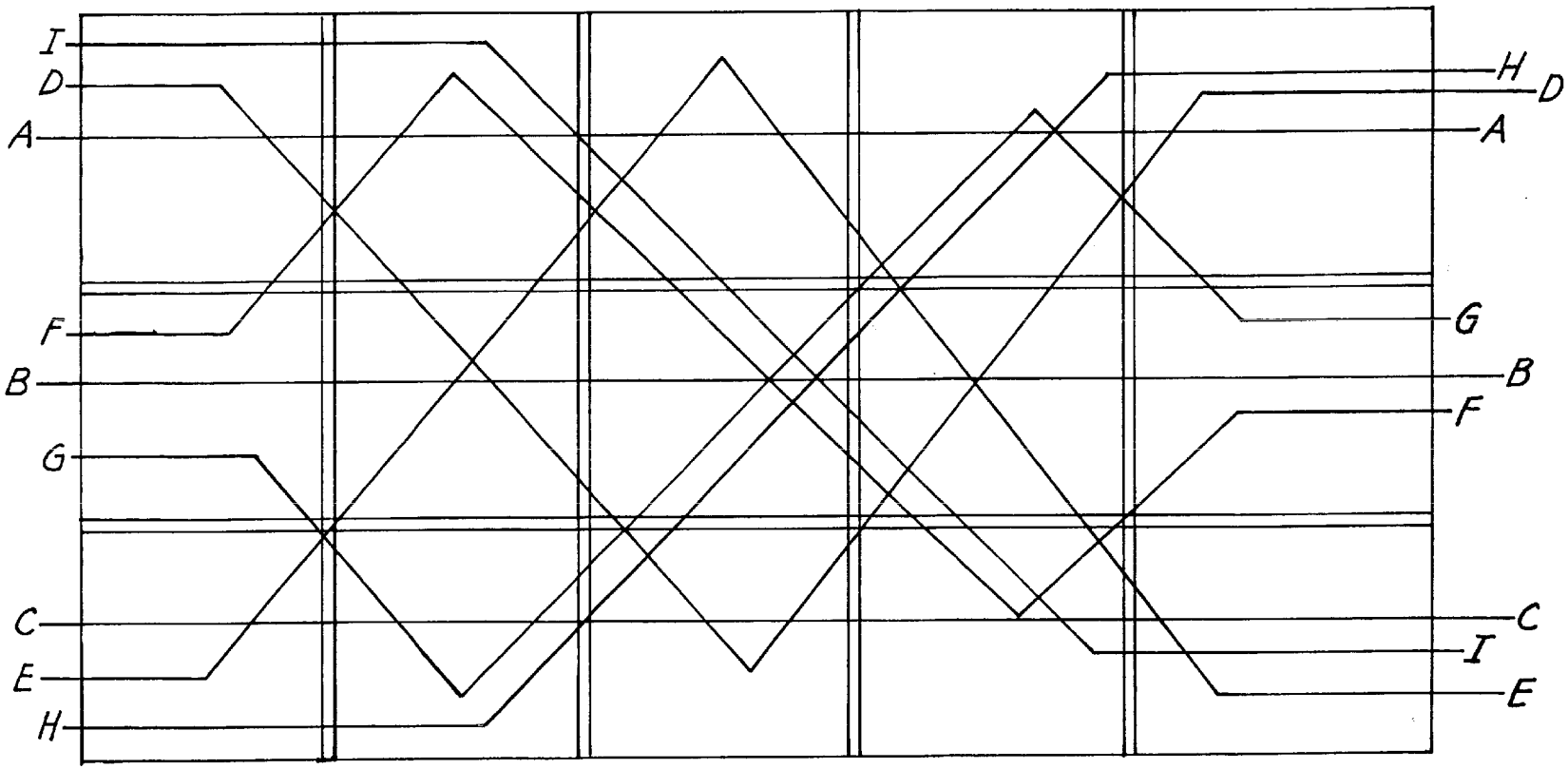
FIGS. 1A and B are front views of the pay lines according to one structural embodiment.
Figure 1B:
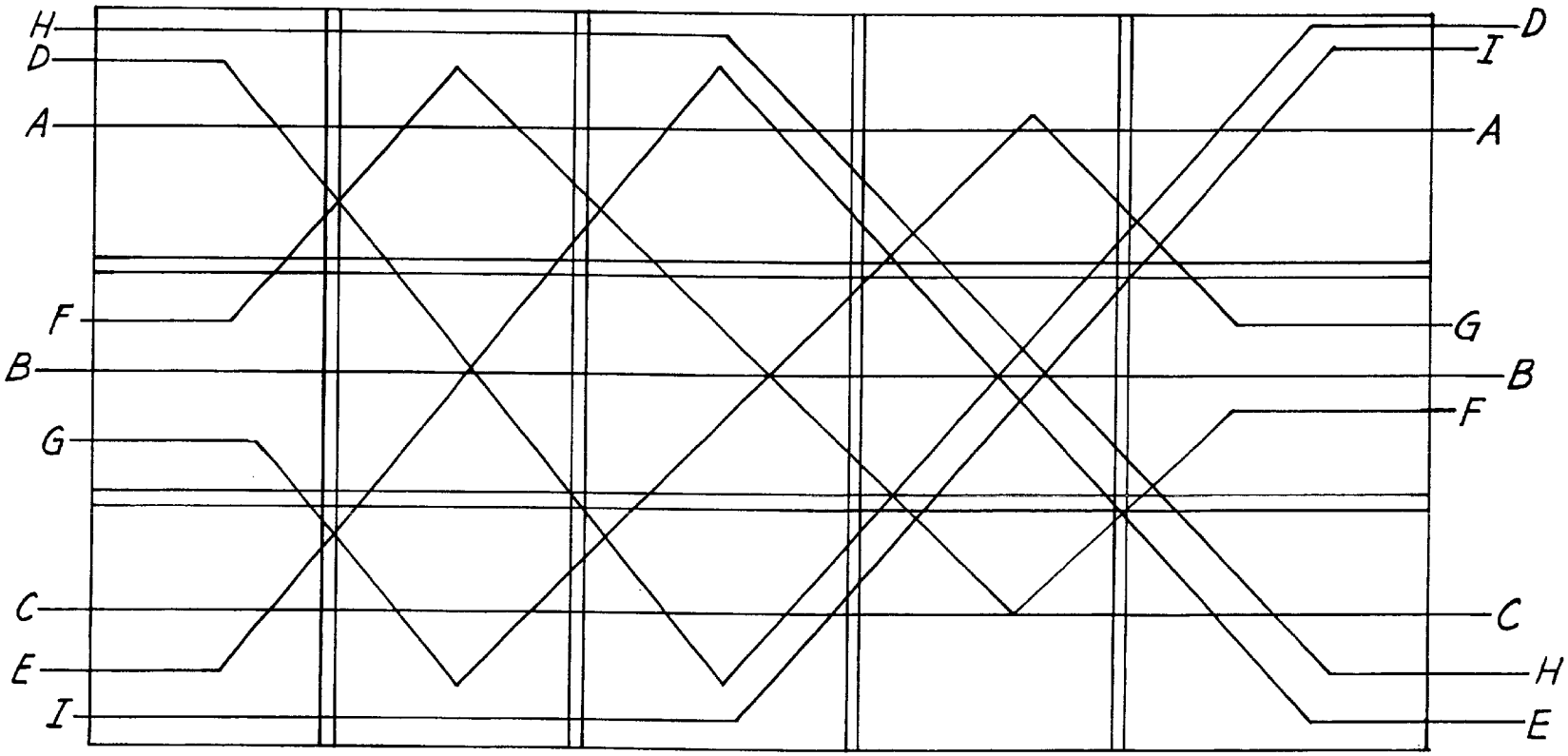

In addition to a scatter pay for the triggering event, the preferred game pays for symbol combinations appearing on one to nine pay lines, as shown in FIG. 1. Pay lines A, B, and C are horizontal pay lines. Pay lines D and E are "V" and inverted "V" shaped lines, respectively. Pay lines F, G, H and I are irregularly shaped lines.

After providing a conclusion to a random event in the play of the first gaming segment (such as by symbols being stopped along a payline in a three or more reel slot machine (real or video), the symbols are examined to determine if a defining event has occurred. A defining event, defined event, or predefined event means in the practice of the present invention that a predetermined random event has occurred that the machine recognizes as a predetermined defined event. For example, the appearance of three specific symbols along a single payline, the appearance of one particular symbol within a payline, or ten consecutive losses are very general examples of defining events (which may also be considered winning events, even where the win is a return of the initial wager, a 1:1 return or any return greater than zero). At least some portion (including all) of either or both the initial wager and any amount awarded to the player for the occurrence of the defining event is then carried forth into the play of the bonus segment, the second gaming segment of the game. In one preferred embodiment, the defining event is the occurrence of, for example, three trigger symbols as a scatter pay. The entrance into the second segment is compulsory and is not optional, and the play of the second segment requires the play of at least one distinct round of play, and preferably at least two distinct rounds of bonus play. When the second segment of the game includes multiple bonus rounds, two or all of the distinct rounds of play require that the amount of wager in the bonus play is multiplied (factored) by an award factor or multiplier determined in the play of the bonus play element of the second gaming segment. The at least one distinct round of bonus play comprises the use of a panel or display of multiple possible factors. The generic term used in the practice of the present invention for any mechanism capable of displaying the group of factors that may be selected in play of this at least distinct round of play in the bonus feature is a factor display. A factor display is any display device (mechanical, electromechanical, electronic, video, flat panel, plasma, liquid crystal display, etc.) that can show multiple panels or multiple display areas, at least some if not all of the panels being capable of displaying alternating (though not necessarily in a specific pattern, although that is an option) factors. By alternating factors it is meant that the same value is not displayed continuously within at least some frames. For example, the factor in a given panel may randomly alternate as 1, 1.5, 0.8, 0.5, 3.0, 1.0, 0.6, 1.5, 1.0, 5.0, 0.4, 0.0, 1.0, 2.0, . . . or 1.0, 1.0, 1.5 or 0.8, 1.0, 1.5, 0.8, 1.0, 1.5, 0.8, 1.0, 1.5. Individual factors may reappear in the group from which the factors are selected, and the selection from the group of numbers (which may be as small as two numbers in the group, preferably three or more numbers in the group) may be random from within the group or in an unvarying sequence. At the same time that factors within at least some of the frames are alternating, a highlighting function is preferably also being enacted. A highlighting function is any visual event that focuses visual attention onto specific frames (less than all frames, preferably one or more frames). In a least preferred embodiment, a pointer such as a virtual arrow or line points to the highlighted frame. More preferably the individual frame undergoes a change in lighting intensity or color or framing color as the highlighting feature. For example, the frame may increase the intensity of illumination within the frame, decrease the intensity of illumination within the frame, change colors within the frame, change background patterns within the frame, change the edging color, edging intensity, edging pattern or edging shape of the frame, change the size of the frame, or any other visually observable change that will indicate to the player that a selection process is operating. The player may then actuate the computer to randomly select a position for stopping the highlighting and thus highlighting a specific factor in that frame. Although the stop actuation gives the impression of control over the selection, by law the selection must be based on random selection rather than true skill. The factor will then be applied to one of 1) the mount wagered in the first game segment, 2) the amount won in the first game segment, or 3) another predetermined amount, to determine the amount that the player is then entitled to carry hold and/or carry forth into a compulsory second bonus play feature of the second gaming segment.

The second bonus play feature may be the same, relatively the same or different from the first bonus play feature in the second gaming segment. For example, either the initial wager, the initial amount won in the play of the first gaming segment, the initial wager plus the amount won in the play of the first gaming segment, the amount won by play in the first bonus play of the second gaming segment or the initial wager and the amount won in the play of the first bonus play in the second gaming segment, or combinations thereof, are wagered in the play of the second bonus play in the second gaming segment. Upon determination of a factor in the play of the second bonus play in the second gaming segment, that second determined factor is preferably applied against the amount won in the first bonus round of the second segment of play. The result of that application of the factor in the second bonus play of the second gaming segment will either determine the absolute amount that the player is then entitled to or is added to any carried over amount that the player was already entitled to. This mathmatic treatment can better be exemplified by consideration of specific award treatments. Assuming a 5 unit initial wager, the player may win, for example, a total of 15 units (the five wagered and ten added to the return of the wager) in the play of the first gaming segment and attains a first defined event that compels the player into a bonus play second gaming segment. Among the options in the design of the game are carrying forth the initial wager (5 units) and retaining the amount added to the returned initial wager (10 units), carrying forth only the amount won (5 units), or carrying forth the amount won less the amount wagered (for a total of 10 units). By way of example only, the amount wagered in the second gaming segment (here for example selected as only the initial wager, so that 5 units are wagered and 10 units are retained by the player) is the amount initially wagered in the play of the first gaming segment. Upon play of the first bonus feature or bonus play in the second gaming segment, a factor of 0.8 is obtained. The player thus has 10 units retained (the amount won in the first gaming segment, but not wagered in the second gaming segment) and 4 units ($0.8\times5=4$) in play in the second gaming segment. The player then advances to a second bonus play in the second gaming segment. Again, there may or may not be an option on what amount may be wagered on this second segment, the choices now being all or part of the amount won in the first gaming segment less the amount wagered (10 units), the amount still controlled from play of the first bonus play of the second gaming segment (4 units) or the total of all (14 units) or part of a combination of the two groups of units. For example only here, it will be assumed that the player may wager only the remainder or totl of the amount resulting from the wager and play of the first bonus play in the second gaming segment (4 units). A randomly selected multiplier is then preferably determined in the second bonus play of the second gaming segment (although selection of a sum certain payout amount to be added or subtracted from the wager may also be used). After the second multiplier is determined, that multiplier is factored against the amount wagered in the play of the second bonus feature in the second gaming segment. If a factor of 1.5 is randomly selected (as by the same or substantially same or different mechanism used in the play of the first bonus play of the second gaming segment), that factor is applied against the amount wagered, in this example, 4 units, and a continuing bonus amount of 6 (1.5×4=6) is now controlled by the player. The player, under this example now has 10 "retained" units plus 6 units in his control. Where there are only two bonus plays in the second gaming segment, the player will then have 16 units added to the credit amount registered on the machine or have 16 units payed out.

In one preferred format of play, the player earns a number of bonus rounds corresponding to the number of trigger symbol outcomes in the first game segment. Preferably three to six rounds are earned. There are therefore multiple opportunities, such as a third bonus play, in the second gaming segment. There are numerous options available in the design of the game for the amount of the wager in the third bonus play and subsequent rounds in the second gaming segment, however, the play and factoring of that amount are generally within the description provided above for play of the second bonus play of the second gaming segment. At the conclusion of a third and last bonus play in the second gaming segment, the total amount returned to the player will be returned as credits or payed out as units (coins or tokens). In the practice of the present invention, a "trigger" symbol is a symbol that is predetermined or preselected to initiate an event by its mere presence on the screen or by its presence within a pay line, whether or not that symbols is in combination with any other symbol. Trigger symbols may be used in sets of 1, 2, 3 or more trigger symbols appearing on the screen or in the view of all pay lines to initiate 1, 2, 3 or more specific events or awards.

The present invention also relates to a method of playing a wagering game comprising:

a player wagering a first amount on a first gaming segment that provides random events;

when a predefined negative random event occurs, the first amount is not returned to the player;

when a predefined positive random event occurs, a second amount, less than, equal to or greater than the first amount is awarded, wherein either the first amount, the second amount or both is available for wagering by the player in a second gaming segment;

a third amount, equal to or greater than the first amount and equal to or less than the second amount is wagered in a second gaming segment;

in the second gaming segment, a factor display is provided comprising a number of factor areas within which factors are displayed, the number being greater than 1;

at least some of the factor areas change the factor displayed within that factor area during play of at least one bonus play in the second gaming segment;

randomly selecting a factor that is displayed;

the randomly selected factor is applied to the third amount to indicate a fourth amount.

That method may include events during play of the at least one bonus play in the second gaming segment, wherein at least one of said number of factor areas is highlighted, as described in greater detail herein. The method may be practiced wherein the highlighting is stopped and the change of factor displays is stopped, with a highlighting feature identifying at least one factor. For example, as also described elsewhere herein, a panel display of frames or display areas in a grid may have individual values of factors or multipliers change with time, while the highlighting feature moves from grid to grid.

An additional method of play includes a method of playing a wagering game comprising:

a player wagering a first amount on a first gaming segment that provides random events;

when a predefined negative random event occurs, the first amount is not returned to the player;

when a predefined positive random event occurs, a second amount, less than, equal to or greater than said first amount is awarded, wherein either the first amount, the second amount or both is available for wagering by the player in a second gaming segment;

a third amount, equal to or greater than the first amount and equal to or less than said second amount is wagered in a second gaming segment;

in said second gaming segment, a factor display is provided comprising a number of factor areas within which factors are displayed, said number being greater than 1;

at least some of the factor areas change the factor displayed within that factor area during play of at least one bonus play in said second gaming segment;

randomly selecting a factor that is displayed;

the randomly selected factor is applied to said third amount to indicate a fourth amount. In this method, during play of the at least one bonus round in said second gaming segment, at least one of said number of factor areas may be highlighted. The method may, as described above, have the highlighting stopped when the change of factor display is stopped, with a highlighting feature identifying at least one selected factor. The method may also progress wherein if the fourth amount is greater than zero, a fifth amount greater than zero is wagered in a second bonus play in said second gaming segment, and if the fourth amount is zero, the play of the wagering game ends, with resolution of any amounts not wagered by the player. The fifth amount is preferably equal to the fourth amount.

In the play of one method of the invention, if the fourth amount is greater than zero, a fifth amount greater than zero is wagered in a second bonus play in said second gaming segment, and if the fourth amount is zero, the play of the wagering game ends, with resolution of any amounts not wagered by the player.

The method may also be played wherein after a fifth amount is wagered, a second bonus play in said second gaming segment is engaged, another factor is determined, that another factor applied to said fifth amount, and a sixth amount is determined.

The method may be played so that the play of the second segment randomly determines a factor by highlighting one or more factors from a group of factors. The highlighting is preferably random. The method wherein in the second segment that randomly determines a factor, symbols are displayed that assign at least one bonus feature selected from the group consisting of extra spin(s), a factor plus extra spin(s), elimination of a spin(s), a directional award allowing a player to move to a new position that determines the randomly determined factor (such as a predetermined numbers of spaces, such as 2), causes the selection of the highest factor and causes the player to lose a bonus round(s). The method may also include a scoring sequence for at least two bonus rounds. That is the game allows for addition or storage and/or identification of amounts won or retained during a sequence or a specific sequence of bonus plays. The scoring sequence is preferably for 2 to 5 bonus rounds. The bonus play may be triggered by the appearance of, for example, three preselected symbols in a scatter pay, as well as conventional predetermined arrangements of pay lines and configurations of symbols or conventional scatter pays. The number of bonus spins may be awarded in play of the first game segment in proportion to each number of trigger figures displayed.

The method may be practiced wherein a spin button is engaged to activate each bonus round. There may be multiple bonus rounds, and between each of the rounds in the multiple bonus rounds, symbols are blanked out. That is, when moving from one bonus round to another or even during the play of a single bonus round, there may be no continuous display of any single symbol or no continuous display of alternating symbols within any frame of the panel. The factors or bonus awards including multipliers may be selected from the group consisting of less than 1, equal to 1, and greater than 1.

Figure 2:
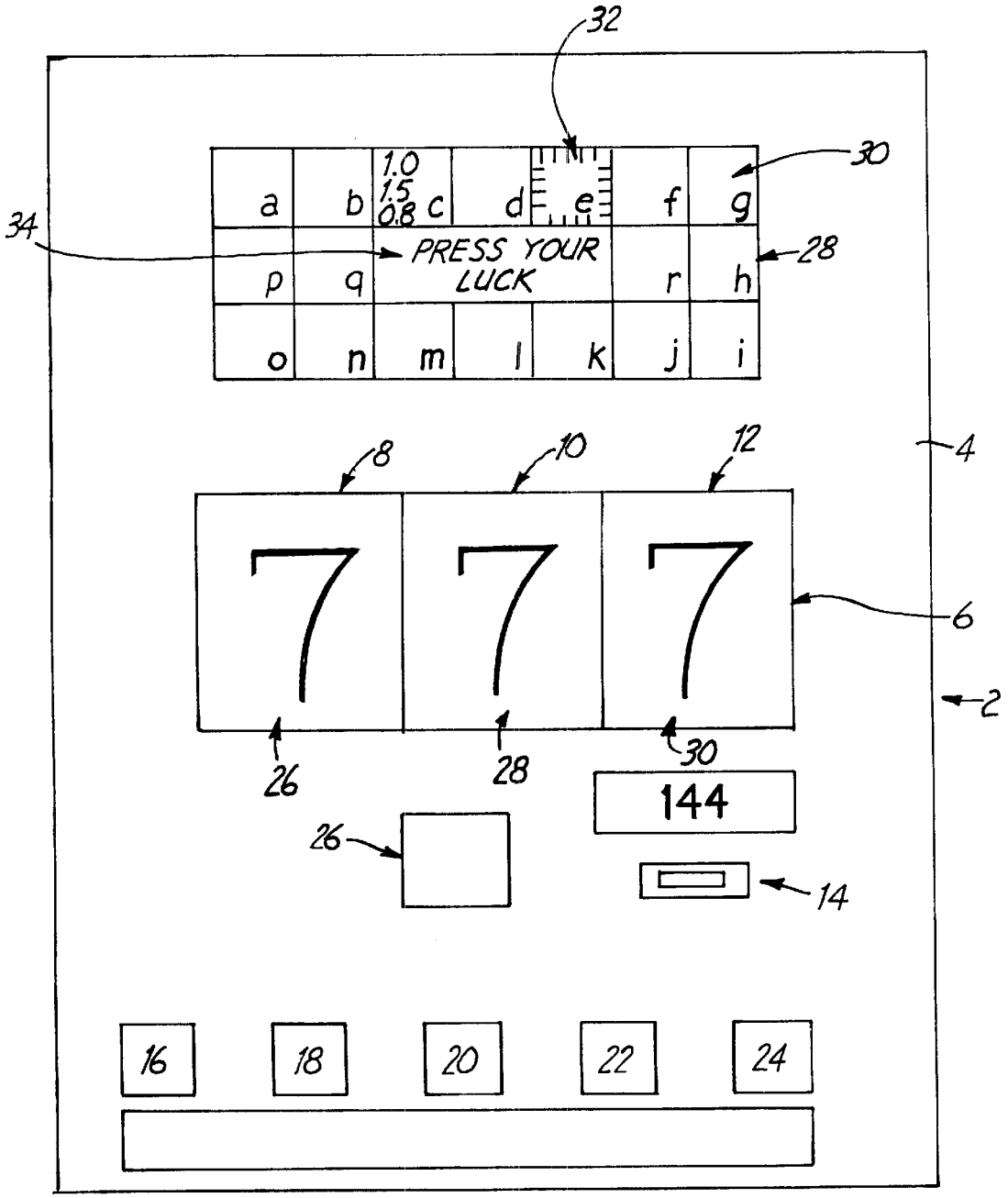
FIG. 2 is a front view of a gaming device according to one structural embodiment of the present invention.

FIG. 2 shows one optional design of a gaming apparatus 2 for practicing the game and process of the present invention. The gaming apparatus 2 comprises a housing 4 with a first gaming segment component 6, here shown as a three reel 8, 10, 12 display panel. After insertion of a desired number of tokens or coins (not shown) in coin slot 14, the first gaming segment is engaged or is engaged by a player pressing an activating button 16. Each of the reels 8, 10, 12 rotates independently to display symbols, and then, as in normal slot machine play, the reels 8, 10, 12 stop in turn, displaying symbols within the frames 8, 10, 12. FIG. 2 shows the display of three sevens as symbols 26, 28, and 30. This combination of symbols is predetermined to be a defining event that compels the player to advance into a second gaming segment. The player indicates, by pressing operation buttons 18, 20 and/or 22 the amount of the wager in the play of the first bonus round in the second gaming segment. For example, button 18 may indicate wagering only the initial wager in the first bonus play in the second gaming segment, button 20 may indicate wagering only the net winnings (retaining the initial wager) in the first round of bonus play of the second gaming segment, and button 22 may indicate wagering the entire winnings in the first bonus play in the second gaming segment. After the amount of the wager in the first bonus play of the second segment is determined (which may also be automatic), the second gaming feature is engaged or activated. A display unit 28 for the view of the second gaming segment is shown as a monitor, but of course any viewing or display system as previously mentioned may be used. The display unit shows, for example only, and not to be considered as a limitation on the practice of the invention, a series of eighteen frames 30 in which will be alternately displayed factors or symbols indicative of or masking factors. For advertising or recognition of the game, a center region 34 is shown with the name of the game "Press Your Luck" lit up therein. A highlighting feature 32 (here shown as increased light intensity around the border of frame e) is moved randomly or in a pattern over each or most of the frames 30. Alternating or replacing factors are displayed within each or some frames. As shown in frame c, alternate factor "1.0" is bright, while the latent factors of "1.5" and "0.8" are soft (actually they would likely not be visible at all, being stored data in a computer (not shown)). The respective factors within frame c would alternate or be shown in a pattern or randomly. A player would press stop button 26 and the computer would randomly position the highlight 32 on a frame 30 and randomly assign a value to the factor within the frame 30. The computer would then compute the amount won in the play of the first bonus round of play in the second gaming segment, and credit that amount to the player. The amount to be wagered in a second bonus play in the second gaming segment would then be determined (either by default, automatically or by selection of the player, as earlier discussed) and the second bonus play in the second gaming segment would be activated or engaged. If the second bonus play of the second gaming segment is the same as that in the first round (or substantially the same with the value or type of factors changing), the play of the second (and third bonus play, if available or required) bonus play would proceed in substantially the same manner as described for the play of the first bonus play.

Another preferred feature of the game of the present invention is that the bonus screen may include additional symbols that serve special functions. One such special symbol entitles the player to a free spin or a multiplier plus a free spin. Another special symbol entitles the player to move a predetermined number of adjacent spaces (for example, two spaces) in a single direction to select a new multiplier or special symbol. Yet another special symbol is a "whammy", in which the player loses a free spin, loses bonus credits, or both. In one preferred embodiment, yet another special symbol allows the player to exchange a lower multiplier plus a free spin for a higher multiplier. An additional special "Big Bucks" symbol functions to provide the player with the highest ranking multiplier displayed on the bonus game display when the special symbol is randomly selected.

In order to enhance the excitement the game and provide the player with some sense of control over game outcomes, an oversized "spin" button is provided. Preferably, the player activates each segment of the bonus round by pressing this button. The button is also pressed to initiate the random selection of a bonus game symbol, such as a special function symbol or multiplier. As the excitement and anticipation of bonus wins increases, the players will tend to hit the button harder. The play of the game may also include the use of a symbol that would award the player the highest ranking multiplier displayed on the screen. That is, when the symbol appeared, either on a payline or in a scatter appearance, the highest ranking multiplier value would be used to compute thre award in that bonus segment. This method could include a symbol that would award the player the highest ranking multiplier in the library of multipliers assigned to the game.

What is claimed is:

1. A method of playing a wagering game comprising:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment if the player obtains a predetermined qualifying outcome in the first game segment;

said second segment randomly determines a factor as a determined factor; and awarding the player a second payout that is equal to the determined factor multiplying at least one of:

a) the wager placed to participate in said game;
b) the first payout amount; and
c) the first payout amount, less said wager placed to participate in said game.

2. The method of claim 1 wherein there is at least a second bonus play in said second segment.

3. The method of claim 2 wherein said second bonus play of said second game segment is substantially the same as the first game segment.

4. The method of claim 1 wherein there is a compulsory third game segment as a bonus play after said second game segment, and a third gaming segment is engaged, another factor is determined, and that factor applied to said at least one of:

a) the wager placed to participate in said game;
b) the first payout amount; and
c) the first payout amount, less said wager placed to participate in said wagering game.

5. The method of claim 1 wherein during play of said second gaming segment, at least one determined factor is highlighted as an area on a display.

6. The method of claim 1 wherein highlighting moves about an area on a display and highlighting is stopped and a change of factor displays is stopped, with the highlighting identifying at least one factor.

7. The method of claim 1 wherein there is a possibility of at least three bonus plays in said wagering game, a first bonus play with a second amount awardable, a second bonus play with a third amount awardable, and a third bonus play with a fourth amount awardable and if the amount wagered in said first bonus play is greater than zero, a third amount greater than zero is wagered in the second bonus play, and if an amount awarded in play of the second bonus play is zero, the play of the wagering game ends, with resolution of any amounts not wagered by the player.

8. A method of playing a wagering game comprising:

a player wagering a first amount on a first gaming segment that provides random events;

when a predefined negative random event occurs, the first amount is not returned to the player;

when a predefined positive random event occurs, a second amount, less than, equal to or greater than said first amount is awarded, wherein either the first amount, the second amount, both first and second amount, or a portion of both the first and/or second amount is available for wagering by the player in a second gaming segment;

a third amount, equal to or greater than the first amount or equal to or less than said second amount is wagered in a second gaming segment;

in said second gaming segment, a factor display is provided, the factor display comprising a number of factor areas within which factors are displayed, said number of factor areas being greater than 1;

at least some of the factor areas change the factor displayed within that factor area during play of at least one bonus play in said second gaming segment;

randomly selecting a factor that is displayed;

applying the randomly selected factor to said third amount to indicate a fourth amount.

9. The method of claim 8 wherein during play of said at least one bonus play in said second gaming segment, at least one of said number of factor areas is highlighted.

10. The method of claim 9 wherein the highlighting is stopped and the change of factor displays is stopped, with a highlighting feature identifying at least one factor at any time during play of the second gaming segment.

11. The method of claim 8 wherein if the fourth amount is greater than zero, a fifth amount greater than zero and less than or equal to the fourth amount is wagered in a second bonus play in said second gaming segment, and if the fourth amount is zero, the play of the wagering game ends, with resolution of any amounts not wagered by the player.

12. The method of claim 11 wherein after a fifth amount is wagered, a second bonus play in said second gaming segment is engaged, another factor is determined, that another factor applied to said fifth amount, and a sixth amount is determined.

13. The method of claim 1 wherein play of said second segment randomly determines a factor and highlights one or more factors from a group of factors.

14. The method of claim 13 wherein said highlighting is random.

15. A method of playing a wagering game comprising:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment if the player obtains a predetermined qualifying outcome in the first same segment;

said second segment randomly determines a factor as a determined factor; and awarding the player a second payout that is equal to the determined factor multiplying at least one of:
a) the wager placed to participate in said game;
b) the first payout amount; and
c) the first payout amount, less said wager placed to participate in said game, wherein in said second segment that randomly determines a factor, symbols are displayed that assign at least one bonus selected from the group consisting of extra spin(s), a factor plus extra spin(s), elimination of a spin(s), a directional award allowing a player to move a position that determines the randomly determined factor, and causes the player to lose a bonus round(s) and a bonus symbol that awards a player the highest ranking displayed factor, and a bonus symbol that awards a player the highest ranking factor assigned to the second game segment.

16. A method of playing a wagering game comprising:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment if the player obtains a predetermined qualifying outcome in the first game segment;

said second segment randomly determines a factor as a determined factor; and awarding the player a second payout that is equal to the determined factor multiplying at least one of:
a) the wager placed to participate in said game;
b) the first payout amount; and
c) the first payout amount, less said wager placed to participate in said game, wherein there is a scoring sequence for at least two bonus rounds.

17. The method of claim 16 wherein there is a scoring sequence for 2 to 5 rounds.

18. A method of playing a wagering game comprising:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment as a bonus play if the player obtains a predetermined qualifying outcome in the first game segment;

said second segment randomly determines a factor as a determined factor; and awarding the player a second payout that is equal to the determined factor multiplying at least one of:

a) the wager placed to participate in said game;

b) the first payout amount; and c) the first payout amount, less said wager placed to participate in said game, wherein said bonus play is triggered by the appearance of three symbols in a scatter pay.

19. A method of playing a wagering game comprising:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment as a bonus play if the player obtains a predetermined qualifying outcome in the first game segment;

said second segment randomly determines a factor as a determined factor; and awarding the player a second payout that is equal to the determined factor multiplying at least one of:

a) the wager placed to participate in said game;

b) the first payout amount; and c) the first payout amount, less said wager placed to participate in said game, wherein said bonus play may comprise a number of bonus spins awarded in proportion to each number of trigger figures displayed.

20. The method of claim 19 wherein a spin button is engaged to activate each bonus round.

21. The method of claim 19 wherein there are multiple bonus rounds, and between each of the rounds in the multiple bonus rounds, symbols are blanked out.

22. The method of claim A method of playing a wagering game comprising:

placing a wager to participate in a game comprising a first and second gaming segment, wherein outcomes of the first gaming segment are based on random symbol selection;

playing the first game segment, wherein if a predetermined qualifying outcome is achieved, awarding the player a first payout;

playing a second game segment as a bonus play if the player obtains a predetermined qualifying outcome in the first game segment;

said second segment randomly determines a factor as a determined factor; and awarding the player a second payout that is equal to the determined factor multiplying at least one of:

a) the wager placed to participate in said game;

b) the first payout amount; and c) the first payout amount, less said wager placed to participate in said game, wherein said factors include multipliers selected from the group consisting of less than 1, equal to 1, and greater than 1.

23. The method of claim 15 wherein there are multiple bonus rounds, and between each of the rounds in the multiple bonus rounds, symbols are blanked out.

24. The method of claim 16 wherein there are multiple bonus rounds, and between each of the rounds in the multiple bonus rounds, symbols are blanked out.

25. The method of claim 17 wherein there are multiple bonus rounds, and between each of the rounds in the multiple bonus rounds, symbols are blanked out.

26. The method of claim 18 wherein there are multiple bonus rounds, and between each of the rounds in the multiple bonus rounds, symbols are blanked out.

27. The method of claim 1 wherein the factor is applied to at least one of:

a) the first payout amount; and b) the first payout amount, less said wager placed to participate in said wagering game.

28. A method of playing a wagering game comprising:

placing a wager to participate in a game comprising a first and second gaming segment, wherein outcomes of the first gaming segment are based on random symbol selection;

playing the first game segment with a set of symbols, wherein if a predetermined qualifying outcome is achieved, awarding the player a first payout;

playing a second game segment if the player obtains a predetermined qualifying outcome in the first game segment, the second segment using at least some symbols used in playing the first game segment;

said second segment randomly determines a factor as a determined factor; and awarding the player a second payout that is equal to the determined factor multiplying at least one of:

a) the wager placed to participate in said game;

b) the first payout amount; and c) the first payout amount, less said wager placed to participate in said game.

* * * * *